United States Patent [19]

Baker et al.

[11] 4,296,808

[45] Oct. 27, 1981

[54] ISOLATION PACKER EXTENSION

[75] Inventors: Eugene E. Baker; Ernest E. Carter, Jr., both of Duncan, Okla.

[73] Assignee: Halliburton Services, Duncan, Okla.

[21] Appl. No.: 174,820

[22] Filed: Aug. 4, 1980

Related U.S. Application Data

[62] Division of Ser. No. 958,706, Nov. 8, 1978.

[51] Int. Cl.[3] ..... E21B 33/124

[52] U.S. Cl. ..... 166/191; 285/133 A

[58] Field of Search ..... 285/133 A, 138; 166/127, 147, 191, 129

[56] References Cited

U.S. PATENT DOCUMENTS

| | | | |
|---|---|---|---|
| 1,521,482 | 12/1924 | Steele | 285/133 A |
| 1,910,442 | 5/1933 | Manning | 166/289 |
| 2,568,087 | 9/1951 | Page | 166/129 X |
| 2,569,437 | 10/1951 | Baker | 166/186 X |
| 2,704,580 | 3/1955 | Brown | 166/129 X |
| 2,795,281 | 6/1957 | Christian | 166/129 X |

*Primary Examiner*—Ernest R. Purser

*Attorney, Agent, or Firm*—John H. Tregoning; James R. Duzan; Lucian Wayne Beavers

[57] ABSTRACT

An isolation packer extension doubles the distance between upper and lower packer assemblies of an isolation packer so that less accurate positioning thereof is required when performing cementing operations from a floating vessel.

5 Claims, 6 Drawing Figures

ISOLATION PACKER EXTENSION

Figure 1:
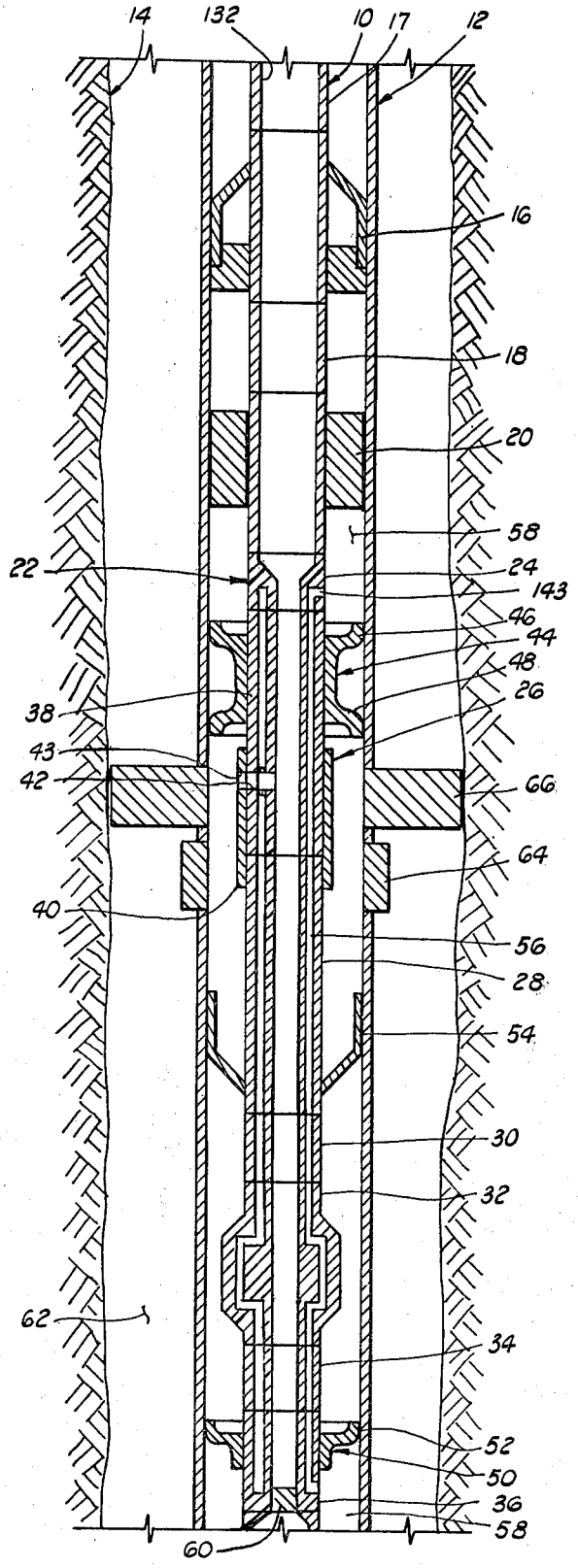

This is a division of our co-pending application Ser. No. 958,706 filed Nov. 8, 1978.

In preparing oil well boreholes for oil and/or gas production, a most important step involves the process of cementing. Basically, oil well cementing is a process of mixing a cement-water slurry and pumping it down through steel casing to critical points located in the annulus around the casing in the open hole below, or in fractured formations. Additionally, it is often desirable to perform other types of chemical treatments upon that annulus around the casing or upon some selected zone of that annulus.

A family of apparatus has been developed for performing such cementing and other treatment operations. One or more full opening cementing tools are interconnected within the well casing. Also, full opening packer collars may be interconnected with the casing. A series of tools are connected to a drill string, which is lowered within the oil well casing, and those tools serve to open and close the various casing ports within the cementing tools and/or packer collars.

A full opening cementing tool, capable of performing an unlimited number of cementing stages in a deep well, has previously been developed. Such a tool is disclosed in U.S. Pat. No. 3,768,562 to Baker, assigned to the assignee of the present invention, and comprises one or more ported cylindrical housings interposed in the casing string, a valve sleeve telescopically located in a recessed area in each housing and capable of opening and closing the ports in the housing for cement flow, and an opening positioner and a closing positioner to be used on a drill string in connection with the closing sleeves and the housings. In addition, the use of that device is advantageously coupled with one or more cementing plugs, isolation packers, and circulating valves to perform various types of cementing operations under various downhole conditions.

Variations of the device of U.S. Pat. No. 3,768,562 are shown in U.S. Pat. Nos. 3,948,322 and 4,105,069 both to Baker and assigned to the assignee of the present invention.

A particular problem is encountered when using apparatus, similar to that described above, in performing cementing or other treatment operations on an oil well from a floating offshore vessel. When operating from an offshore vessel, less accurate positioning of the drill string relative to the well casing is possible, as compared to on shore operation, because of the motion of the floating vessel induced by ocean waves.

This problem particularly is present when performing cementing and/or treatment operations of the type just described. The problem arises when attempting to position an isolation packer adjacent a cementing port in the casing and to retain the isolation packer in that position during the cementing procedure.

The present invention overcomes those difficulties by the provision of a lower extension which effectively doubles the distance between upper and lower packer assemblies on the typical isolation packer, and by the addition to the drill string of an anchor means. The anchor means selectively engages the casing to provide a sufficient resistance between the drill string and the casing to operate a motion compensator on the floating vessel. The motion compensator system on the floating vessel then adjusts the effective length of the drill string as needed to compensate for wave induced vertical motion of the floating vessel.

The isolation packer of the present invention includes a tubular body having an inner mandrel disposed concentrically therein. The typical length of such assemblies in the prior art has been from eight to ten feet between upper and lower packer assemblies. In order to effectively double the length of such an isolation packer, the inner mandrel must be extended to a length of approximately twenty feet. The provision of a one-piece inner mandrel of the appropriate quality in a length of twenty feet presents significant problems in that such lengths of tubing of that quality are not readily available.

To overcome this problem, the present invention, therefore, uses upper and lower inner mandrels, each of which are connected to a middle body. In addition to solving the materials problem, this allows isolation packers of the prior art to be modified for use on floating vessel operations by merely removing a lower body of those prior art isolation packers and connecting the middle body of the present invention to the point where the lower body was previously connected.

In order to allow the drill string to be lowered and raised within the oil well casing, a bypass is provided around the upper and lower packer assemblies. A portion of such bypass is comprised of a middle body bypass means attached to the middle body of the present invention.

Such an extended length isolation packer allows for considerable error in positioning the isolation packer within the casing, while still achieving suitable operation of the isolation packer in combination with the various casing valves.

FIG. 1 is a schematic elevation view of the drill string of the present invention in place within an oil well casing located within an oil well bore.

Figure 2:
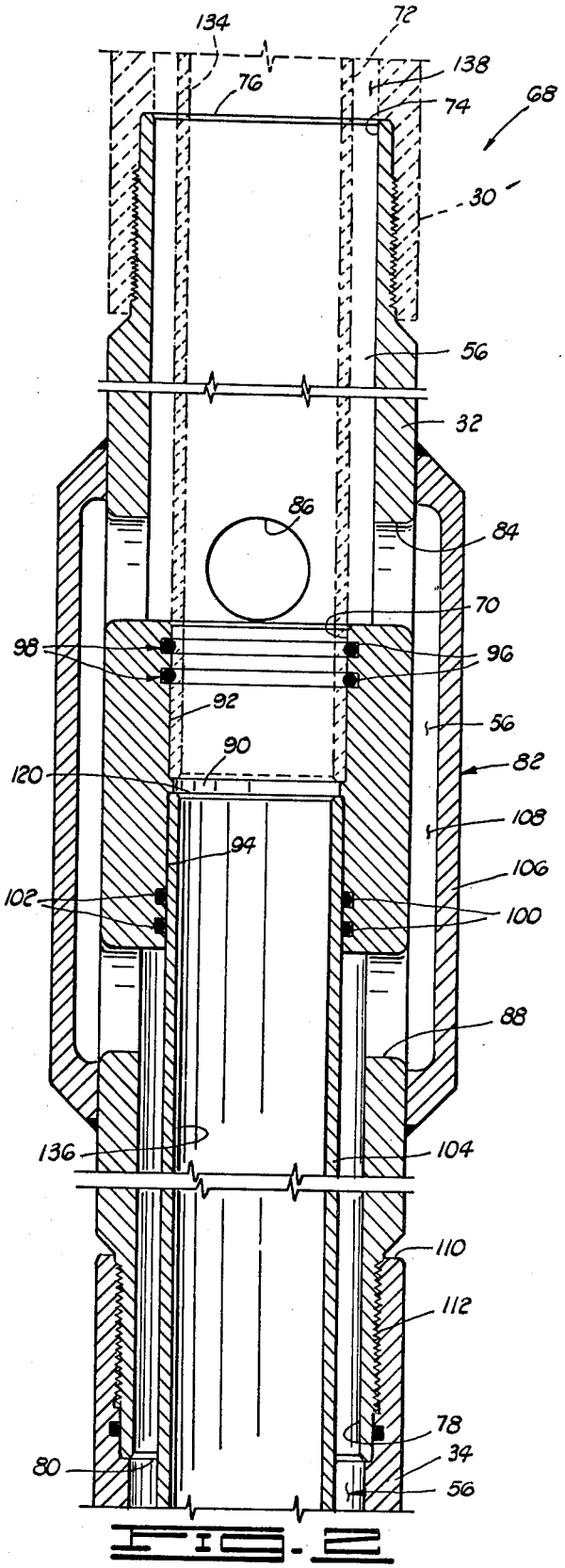
Figure 2A:
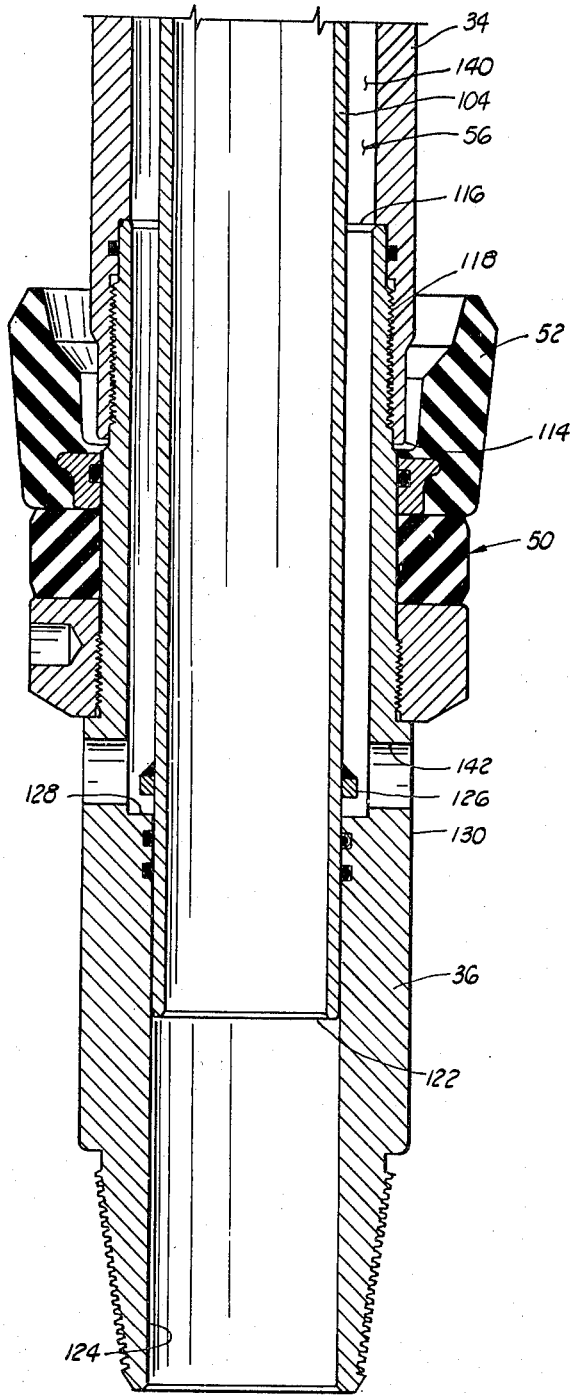

FIGS. 2 and 2A comprise an elevation sectional view of the isolation packer extension of the present invention.

Figure 3:
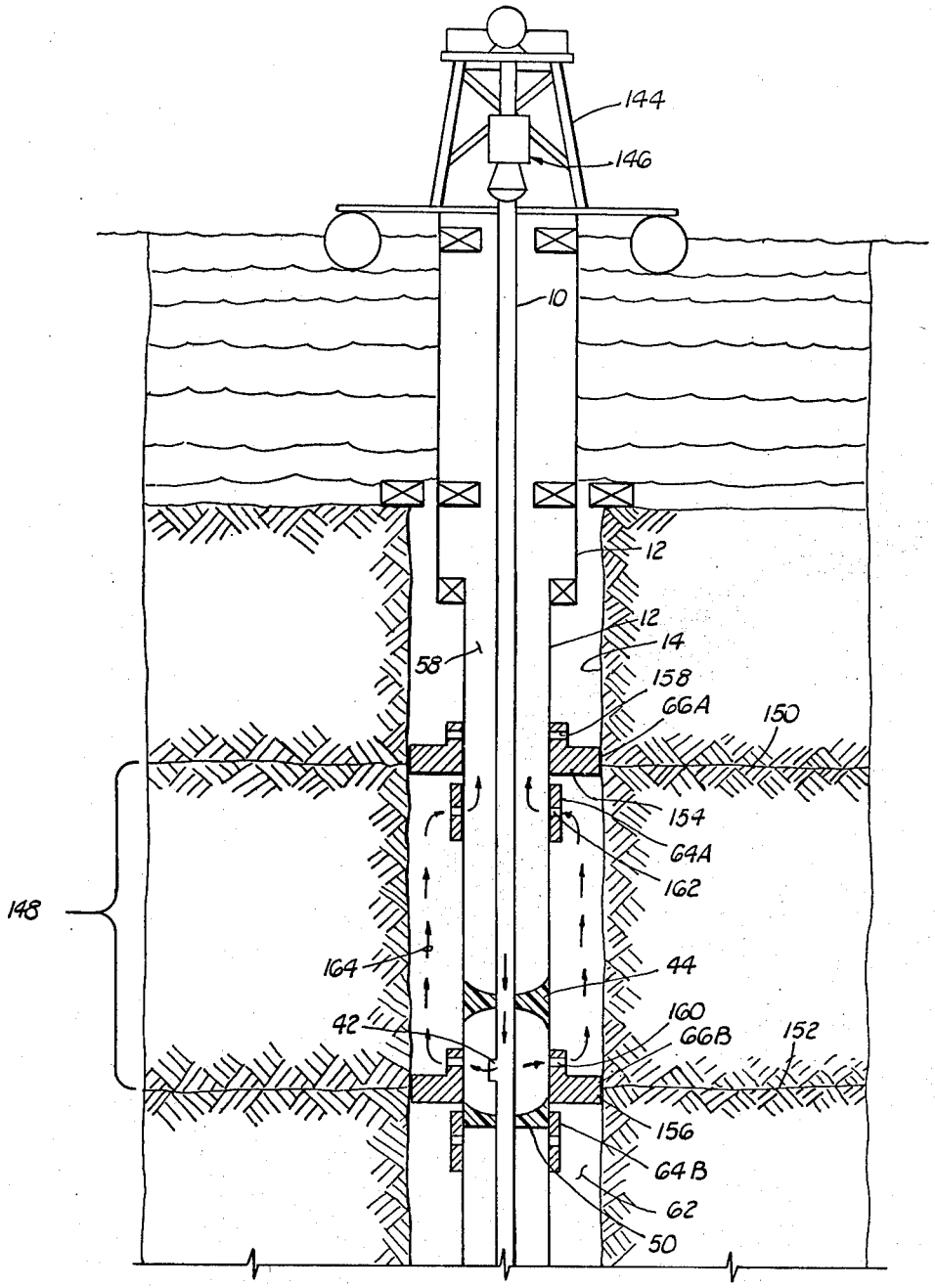

FIG. 3 is a schematic elevation view of a drill string, suspended from a floating vessel, within an oil well casing having a plurality of casing valves and packer collars arranged for selected treatment of a zone of said well.

Figure 4:
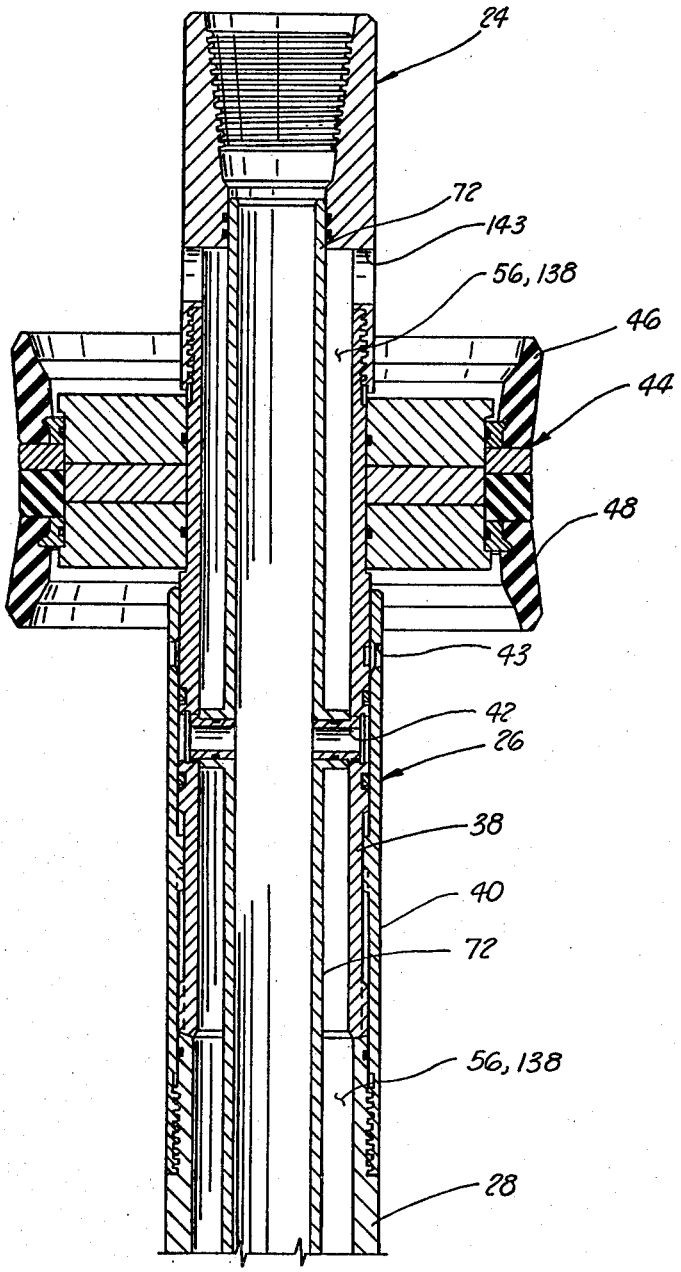
Figure 4A:
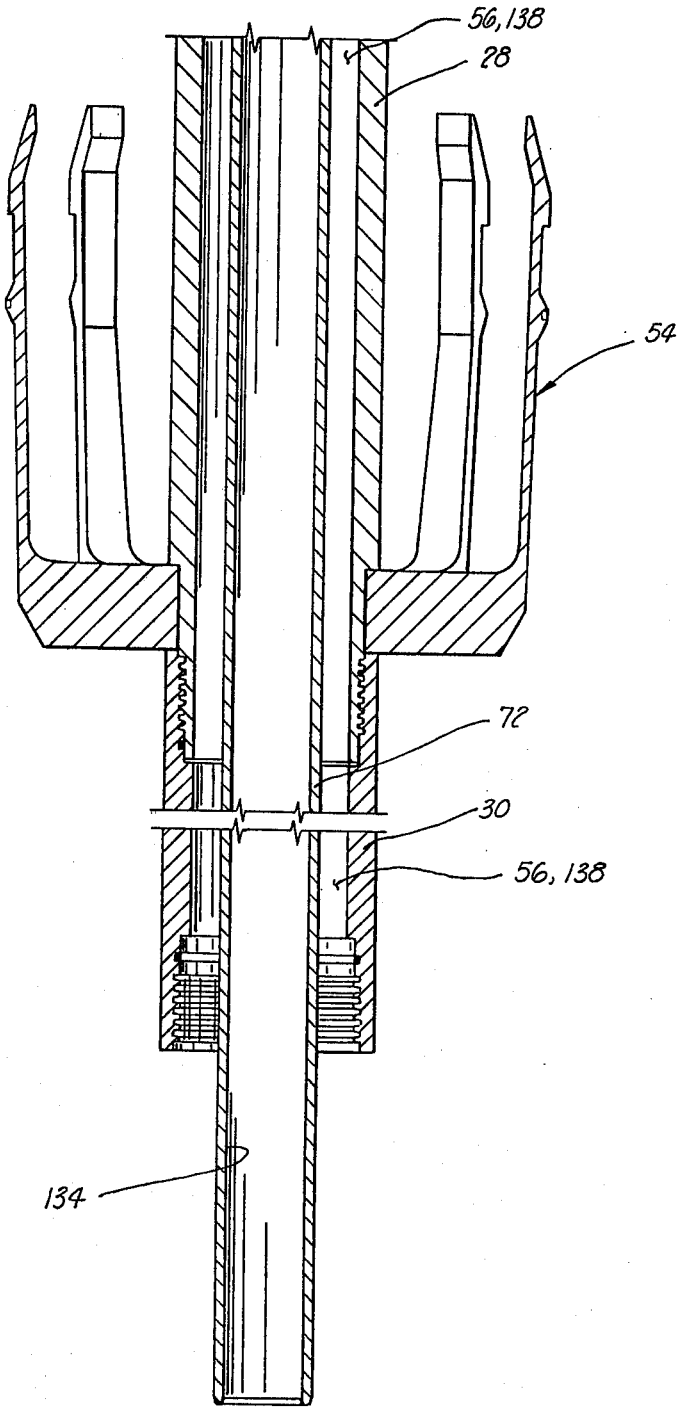

FIGS. 4 and 4A comprise an elevation sectional view of the upper tubular body assembly of the isolation packer of the present invention.

Referring now to the drawings, and particularly to FIG. 1, the drill string of the present invention is shown and generally designated by the numeral 10. The drill string 10 is concentrically located within oil well casing 12 which is itself located within oil well borehole 14.

The drill string 10 includes a selective release opening positioner 16, the details of which are described in U.S. Pat. No. 4,105,069 to Baker, which is hereby incorporated herein by reference. Above positioner 16 there is a long length of drill pipe 17.

Connected below opening positioner 16 is a length of drill string tubing or pipe 18. Connected below pipe 18 is anchor means 20. The anchor means 20 is preferably comprised of any one of a number of commercially available packers designed to seal the annulus between the drill string and the casing. It is often preferable to remove the packer sealing elements from these packers, since the sealing function is not required when using the packer merely as an anchor.

Connected below anchor means 20 is an extended length isolation packer generally designated by the numeral 22. Isolation packer 22 includes an upper body 24, a slip joint port valve 26, a positioner mandrel 28, an upper spacer coupling 30, a middle body 32, a lower spacer coupling 34, and a lower body 36.

The slip joint port valve 26 and positioner mandrel 28 comprise an outer mandrel connected to the upper body 24. In a standard isolation packer, i.e., without the slip joint port valve 26, the outer mandrel is one continuous member.

The upper body 24, slip joint port valve 26, positioner mandrel 28 and upper spacer coupling 30 comprise an upper tubular body assembly. This upper tubular body assembly is shown in greater detail in FIGS. 4 and 4A.

The lower spacer coupling 34 and lower body 36 comprise a lower tubular body assembly.

Slip joint port valve 26 includes a slip joint mandrel 38 attached to upper body 24, and a slip joint sleeve 40 slidingly engaging an outer cylindrical surface of slip joint mandrel 38. Slip joint mandrel 38 has a port 42 disposed therethrough. As is best seen in FIG. 4, the port 42 is disposed through both the slip joint mandrel 38 and an upper inner mandrel 72 which is described in more detail below. In a first closed position of slip joint port valve 26, sleeve 40 blocks port 42 closing it. In a second open position of slip joint port valve 26, a radial bore 43 of sleeve 40 is aligned with port 42 thereby providing communication between the inside of drill string 10 and the annulus between drill string 10 and casing 12.

Attached to slip joint mandrel 38 above port 42 is upper packer assembly 44. Upper packer assembly 44 includes first and second sealing cups 46 and 48, respectively, for sealingly engaging an interior of oil well casing string 12. First cup 46 is located above second cup 48, and is concave upwards to seal against flow of fluids in a downward direction. Second cup 48 is concave downwards to seal against flow of fluids in an upward direction.

Attached to lower body 36 is lower packer assembly 50 which includes third cup 52 which is concave upwards.

Extended length isolation packer 22 has a distance of at least fifteen feet between upper and lower packer assemblies 44 and 50, and preferably has a distance of approximately twenty feet between upper and lower packer assemblies.

Attached to positioner mandrel 28 is a sleeve closing positioner 54, the details of construction of which are shown in U.S. Pat. No. 4,105,069 to Baker.

A fluid bypass 56 provides a means by which fluid located within an inner annulus 58 between drill string 10 and casing 12, above upper packer assembly 44, is communicated with the annulus 58 below lower packer assembly 50. This allows the isolation packer 22 to be raised and lowered within the casing 12 without displacing the working fluid which fills the annulus 58.

When cementing through port 42, a lower end of the drill string 10 must be blocked by plug 60.

The tools just described, which are attached to the drill string 10, are used in conjunction with one or more of the various types of casing valves available which provide selective communication between the inner annulus 58 and an outer annulus 62 between casing 12 and borehole 14.

Preferably, the casing valves comprise one or more of two types of casing valves. A full opening cementing tool 64, such as is described in U.S. Pat. No. 3,768,562 to Baker, may be used. The details of construction of full opening cementing tool 64 as described in U.S. Pat. No. 3,768,562 are hereby incorporated herein by reference. Cementing tool 64 may be referred to as a sliding sleeve cementing valve.

Also, it may be desirable to use a full opening packer collar 66 such as is described in U.S. Pat. No. 3,948,322 of Baker, particularly with reference to FIG. 8 thereof. The details of construction of full opening packer collar 66 as described in U.S. Pat. No. 3,948,322 are hereby incorporated herein by reference.

As will be described in more detail later, it is often desirable to use a full opening packer collar 66 in combination with a full opening cementing tool 64 located directly below packer collar 66.

Referring now to FIGS. 2 and 2A, the isolation packer extension of the present invention is shown and generally designated by the numeral 68.

Isolation packer extension 68 includes the cylindrical middle body 32 having an axial bore 70 therethrough. Axial bore 70 closely receives an upper inner mandrel 72 therein. Upper inner mandrel 72 is the equivalent of the inner mandrel 42 of the port valve isolation packer shown in U.S. patent application No. 941,753, now U.S. Pat. No. 4,192,378, issued Mar. 11, 1980, assigned to the assignee of the present invention. The isolation packer extension 68 is constructed for addition to the lower end of port valve isolation packer 10 of U.S. patent application No. 941,753 after removal of the lower body thereof, as will be apparent from the following description. Those portions of port valve isolation packer 10 of U.S. patent application No. 941,753 utilized in combination with the isolation packer extension 68 to form extended length isolation packer 22 are shown in detail in FIGS. 4 and 4A. Isolation packer extension 68 may similarly be used with a standard isolation packer, i.e., without the slip joint port valve, such as the isolation packer disclosed in U.S. Pat. No. 3,768,562 to Baker.

Cylindrical middle body 32 further includes a first axial counterbore 74 communicating with an upper end 76 of middle body 32. A second axial counterbore 78 communicates with a lower end 80 of middle body 32.

Isolation packer 68 further includes a middle body bypass means 82 communicating said first axial counterbore 74 with said second axial counterbore 78.

Middle body 32 further has disposed therein a first radial bore 84 intersecting said first axial counterbore 74. A supplementary radial bore 86 is disposed in middle body 32 coplanar with first radial bore 84 at an angle of 90° thereto.

Middle body 32 also has disposed therein a second radial bore 88 intersecting said second axial counterbore 78.

Middle body 32 includes a radially inward projecting ridge 90 dividing said axial bore 70 into an upper bore portion 92 and a lower bore portion 94.

Upper bore portion 92 has disposed therein a pair of annular grooves 96 which receive resilient sealing rings 98 for sealing between upper inner mandrel 72 and upper bore portion 92.

Lower bore portion 94 has disposed therein a pair of annular grooves 100 which have disposed therein resilient sealing rings 102 which seal between upper bore portion 94 and a lower inner mandrel 104.

Middle body bypass means 82 includes an outer jacket 106 defining an annular bypass cavity 108 between said outer jacket 106 and said cylindrical middle body 32, said bypass cavity 108 communicating with said first and second radial bores 84 and 88, respectively.

Lower spacer coupling 34 is connected at an upper end 110 to the lower end 80 of middle body 32 by threaded connection 112.

Lower spacer coupling 34 is constructed for connection at its lower end 114 to an upper end 116 of lower body 36 by threaded connection 118.

An upper end 120 of lower inner mandrel 104 is closely received wtihin said lower portion 94 of axial bore 70 of middle body 32. A lower end 122 of lower inner mandrel 104 is constructed to be closely received within an axial bore 124 of lower body 36. Lower inner mandrel 104 includes a radially outward projecting ridge 126 located above lower end 122, said ridge 126 being constructed for engagement with a radially inner shoulder 128 of lower body 36 to limit downward movement of said lower inner mandrel 104 relative to lower body 36.

Bypass 56 communicates a radially outer surface of upper body 24 above upper packer assembly 44 with a radially outer surface 130 of lower body 36 below lower packer assembly 50, said bypass 56 being in fluid isolation from an inner cavity or inner bore 132 of drill string 10 and inner bores 134 and 136 of upper and lower inner mandrels 72 and 104, respectively.

Bypass 56 comprises an upper annular cavity 138 defined between upper inner mandrel 72 and said upper body 24, slip joint port valve 26, positioner mandrel 28, upper spacer coupling 30, and middle body 32. Bypass 56 also includes a lower annular cavity 140 defined between lower inner mandrel 104 and said middle body 32, lower spacer coupling 34 and lower body 36.

As previously described, bypass 56 includes middle body bypass means 82 which includes annular bypass cavity 108 which communicates upper annular cavity 138 with lower annular cavity 140. Bypass 56 also includes a lower radial bore 142 disposed in lower body 36 and intersecting lower annular cavity 140. Upper body 24 includes a similar upper radial bore 143 intersecting upper annular cavity 138 above upper packer assembly 44.

The methods of operation of the present invention are best described with reference to FIGS. 1 and 3. FIG. 3 illustrates, in schematic elevation form a floating vessel 144 including a wave motion compensation system 146 from which the drill string 10 is suspended. First the method of stage cementing of annular cavity 62 will be described. The lower first stage of the annular cavity 62 is cemented either in a conventional or by the inner string method, both of which are described in the U.S. Pat. No. 3,768,562 to Baker. The second, third and later stages of cementing may then be performed by the following method, which is illustrated in FIG. 1. The casing 12 includes casing valves 64 and 66, which more specifically have previously been described as full opening cementing tool 64 and full opening packer collar 66.

The first step in the method comprises running the drill string 10 into the casing 12. Then, opening positioner 16 is engaged with the sliding sleeve of full opening cementing tool 64. Then, drill string 10 is lifted to open cementing tool 64 and opening positioner 16 disengages from cementing tool 64 upon reaching the open position.

Then drill string 10 is positioned to align extended length isolation packer 22 with full opening cementing tool 64 so that upper packer assembly 44 sealingly engages casing 12 above cementing tool 64 and lower packer assembly 50 sealingly engages casing 12 below cementing tool 64.

Then the anchor means 20 is set against casing 12 to provide sufficient resistance between drill string 10 and casing 12 to operate motion compensator 146 on the floating vessel 144.

Then, a cement slurry is pumped into drill string 10, out port 42 of isolation packer 22, through the opened cementing tool 64, into the annulus or annular cavity 62 between the casing 10 and borehole 14.

Preferably, the isolation packer 22 is an extended length isolation packer as described herein, having a distance between upper and lower packer assemblies of at least fifteen feet, and isolation packer 22 includes a fluid bypass 56 communicating inner annular cavity 58 above the upper packer assembly 44 with that same inner annular cavity 58, below lower packer assembly 50.

After completing the cementing operation, the excess cement slurry remaining between upper and lower packer assemblies 44 and 50, respectively, and within the drill string 10 should be reversed out. Said reversing out procedure is accomplished by pumping a working fluid into annular cavity 58 through fluid bypass 56 into the annular cavity 58 below lower packer assembly 50 and then up past the lower packer assembly 50, thereby forcing the excess cement through the port 42 of isolation packer 22 and up the inner bore 132 of drill string 10, ahead of the working fluid.

After the reversing out procedure is completed, the anchor means 20 is released so that the drill string 10 may once again be reciprocated within casing 12. Then, closing positioner 54 is engaged with cementing tool 64 and drill string 10 is lowered to close cementing tool 64.

Referring now to FIG. 3, there is there illustrated a method of isolating a selected zone 148 of the oil well bore hole 14. Zone 148 is isolated so that it may be selectively cemented or treated in some other manner. The casing 12 has interconnected therein at the upper and lower boundaries 150 and 152, respectively, of zone 148, upper and lower full opening packer collars 66A and 66B. Packer collars 66A and 66B comprise upper and lower borehole packer means which include full opening inflatable packers 154 and 156, respectively, with casing ports 158 and 160 located above inflatable packers 154 and 156, respectively. As is described in U.S. Pat. No. 3,948,322, casing ports 158 and 160 are automatically opened upon inflation of the packers 154 and 156, respectively. Full opening cementing tools 64A and 64B are located directly below inflatable packers 154 and 156, respectively.

The first step of the method of selective treatment of zone 148 consists of running drill string 10 into casing 12.

Then, the lower borehole packer means or lower full opening packer collar 66B is inflated in the following manner. The drill string 10 is lowered to place the selective release opening positioner 16 immediately below lower full opening packer collar 66B. Opening positioner 16 is then activated by starting the drill string down, rotating the drill string 10 to the right to release the fingers of opening positioner 16 and once again picking up on drill string 10 as it is described in U.S. Pat. No. 4,105,069 to Baker. Then, the opening positioner 16 is pulled upwards to move the sliding sleeve of full opening packer collar 66B and inflatable packer 156 is inflated to approximately 1,000 PSI to seal outer annular cavity 62 and to automatically open casing port 160 of lower full opening packer collar 66B.

Selective release opening positioner 16 is then deactivated by setting down weight on the drill pipe which retracts the fingers of opening positioner 16.

The drill string 10 is then lifted to pull opening positioner 16 up past upward full opening cementing tool 64A.

The upper borehole packer means or upper full opening packer collar 66A is then inflated in the following manner. Selective release opening positioner 16 is reactivated. Opening positioner 16 is then engaged with the sliding sleeve of full opening packer collar 66A and packer collar 66A is then inflated in a manner similar to that by which the lower packer collar 66B was inflated. Opening positioner 16 is then once again deactivated. Drill string 10 is then lifted to engage closing positioner 54 with the sliding sleeve of upper full opening packer collar 66A and drill string 10 is then lowered to close casing port 158 of upper full opening packer collar 66A.

A casing port 162 of upper full opening cementing tool 64A is then opened as follows. Selective release opening positioner 16 is once again activated and is engaged with a sliding sleeve of upper full opening cementing tool 64A. Then, drill string 10 is lifted to open casing port 162 of upper full opening cementing tool 64A.

Then, drill string 10 is positioned to align extended length isolation packer 22 with casing port 160 of lower full opening packer collar 66B so that casing port 160 is located between upper and lower packer assemblies 44 and 50, respectively.

Then anchor means 20 is set against casing 12 to provide sufficient resistance between drill string 10 and casing 12 to operate the motion compensator 146.

Finally, a fluid such as cement or some such chemical treatment fluid is pumped into drill string 10, out isolation packer port 42, through casing port 160 and up the annular cavity 62 as indicated by arrows 164.

After cementing, the ports 160 and 162 are both closed and the excess cement may be reversed out by pumping down the inner annular cavity 58.

The isolation packer 22 may also be used to test the seal provided by any one of the casing ports, by positioning the isolation packer across said casing port and pressure testing to approximately 1500 PSI.

By placing a full opening packer collar 66 and a full opening cementing tool 64 at each boundary of each zone which may be desired to be treated, it will be apparent to those skilled in the art that this method of selective treatment may be used on any of said zones.

Thus, the isolation packer and methods of cementing from a floating vessel of the present invention are well adapted to obtain the ends and advantages mentioned as well as those inherent therein. While presently preferred embodiments of the invention have been described for the purpose of this disclosure, numerous changes in the construction and arrangement of parts and steps can be made by those skilled in the art, which changes are encompassed within the spirit of this invention as defined by the appended claims.

What is claimed is:

1. An isolation packer extension, comprising:

a cylindrical middle body, said middle body including an axial bore therethrough for receiving an upper inner mandrel therein, a first axial counterbore communicating with an upper end of said middle body, and a second axial counterbore communicating with a lower end of said middle body;

a bypass means, communicating said first axial counterbore with said second axial counterbore;

a spacer coupling, connected at an upper end to said middle body, said spacer coupling being constructed for connection at its lower end to a lower body, to which lower body is attached a lower packer assembly; and a lower inner mandrel, an upper end of which is closely received in said axial bore of said middle body, and a lower end of which is constructed to be closely received within an axial bore of said lower body.

2. Apparatus of claim 1, wherein:

said middle body further includes a first radial bore, intersecting said first axial counterbore of said middle body, and a second radial bore, intersecting said second axial counterbore of said middle body; and said bypass means includes an outer jacket defining an annular bypass cavity between said outer jacket and said cylindrical middle body, said bypass cavity communicating with said first and second radial bores.

3. Apparatus of claim 1, wherein:

said middle body includes a radially inward projecting ridge dividing said axial bore into an upper and a lower bore portion.

4. Apparatus of claim 3, wherein:

said upper bore portion has disposed therein an annular groove for receiving a resilient sealing ring to seal between said upper inner mandrel and said upper bore portion; and said lower bore portion has disposed therein an annular groove for receiving a resilient sealing ring to seal between said lower inner mandrel and said lower bore portion.

5. Apparatus of claim 1, wherein:

said lower inner mandrel includes a radially outward projecting ridge for engagement with said lower body to limit downward movement of said lower inner mandrel relative to said lower body.

* * * * *